US011865424B1

(12) United States Patent
Mobley

(10) Patent No.: US 11,865,424 B1
(45) Date of Patent: Jan. 9, 2024

(54) GOLF TRAINING TOOL

(71) Applicant: Orson Odell Mobley, Jacksonville, FL (US)

(72) Inventor: Orson Odell Mobley, Jacksonville, FL (US)

( * ) Notice: Subject to any disclaimer, the term of this patent is extended or adjusted under 35 U.S.C. 154(b) by 0 days.

(21) Appl. No.: 17/934,323

(22) Filed: Sep. 22, 2022

(51) Int. Cl.
*A63B 69/36* (2006.01)
*A63B 69/00* (2006.01)

(52) U.S. Cl.
CPC ..... *A63B 69/0057* (2013.01); *A63B 69/3623* (2013.01); *A63B 2214/00* (2020.08)

(58) Field of Classification Search
CPC ..... A63B 69/0057; A63B 69/3623; A63B 2214/00
USPC ..... 473/207, 212–214, 266, 276
See application file for complete search history.

(56) References Cited

U.S. PATENT DOCUMENTS 5,096,199 A * 3/1992 Wyatt, Jr. ..... A63B 21/0442 473/215
5,259,621 A * 11/1993 Keefer ..... A63B 69/0059 473/227
5,295,690 A 3/1994 Johnson
5,447,312 A * 9/1995 Nixon ..... A63B 69/0059 273/DIG. 30
5,902,189 A 5/1999 Schultz
6,126,554 A 10/2000 Poscente
6,176,790 B1 1/2001 Latella
6,805,640 B2 10/2004 Kim et al.
7,033,284 B2 * 4/2006 Yoshimura ..... A63B 69/0059 473/227
7,585,229 B2 9/2009 Kelley
7,635,308 B2 12/2009 Merrill
7,758,437 B1 7/2010 Stewart
7,896,756 B2 * 3/2011 Choi ..... A63B 69/0059 473/214
7,976,398 B2 * 7/2011 Clawson ..... A63B 69/0059 473/227
9,072,957 B1 7/2015 Chuck
9,682,304 B2 6/2017 Vilhelmsen
2008/0167135 A1 7/2008 Naito et al.
2009/0197692 A1 8/2009 Eck
2019/0030413 A1 1/2019 Walkey et al.
2021/0379461 A1 12/2021 Mulloy

* cited by examiner

*Primary Examiner* — Nini F Legesse
(74) *Attorney, Agent, or Firm* — Dunlap Bennett & Ludwig, PLLC

(57) ABSTRACT

A golf training tool and associated method are disclosed herein. The training tool includes a substantially trapezoidal main body that, in use, is retained between a front arm and a rear arm of a golfer, the main body includes: a top surface, a bottom surface shorter in length than the top surface, a front side surface, and a rear side surface. The front side surface defines a front arm recess designed to receive the front arm of the golfer. The rear side surface defines a rear arm recess designed to receive the rear arm of the golf. In use, the main body is retained in place by only the front arm and the rear arm of the golfer and without one or more external supports.

8 Claims, 4 Drawing Sheets

GOLF TRAINING TOOL

BACKGROUND OF THE INVENTION

The present invention relates to golf training tools and, more particularly, to a tool that fits between golfers' arms to teach proper arm and body connection.

At the present, there are no effective tools at preventing golfers from getting serious injuries from swinging incorrectly. Existing devices are difficult to use, in particular, for those with limited mobility, large chests, or have upper body injuries (e.g., shoulder injuries). Skilled golfers have loose and fluid swings, not rigid ones. In contrast, devices, like training balls, are difficult to hold between the golfer's arm and still swing smoothly.

As can be seen, there is a need for a golf training tool as disclosed herein. The present invention teaches correct backswing and follow-through motion.

SUMMARY OF THE INVENTION

In one aspect of the present invention, a golf training tool for a golfer is disclosed that includes: a substantially trapezoidal main body configured to be retained between a front arm and a left arm of a golfer, the main body comprising: a top surface; a bottom surface shorter in length than the top surface; a front side surface defining a front arm recess configured to receive the front arm of the golfer; and a rear side surface defining a rear arm recess configured to receive the rear arm of the golfer, wherein, in use, the main body is configured to be retained in place by only the front arm and the rear arm of the golfer and without one or more external supports.

In another aspect of the present invention, a method of training a golfer is disclosed, with the method including: providing a golf training tool comprising: a substantially trapezoidal main body configured to be retained between a front arm and a rear arm of a golfer, the main body comprising: a top surface; a bottom surface shorter in length than the top surface; a front side surface defining a front arm recess configured to receive the front arm of the golfer; and a rear side surface defining a rear arm recess configured to receive the rear arm of the golfer; and positioning the main body between a front arm and a rear arm of the golfer, wherein the main body is retained in place by only the front arm and the rear arm of the golfer and without one or more external supports.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
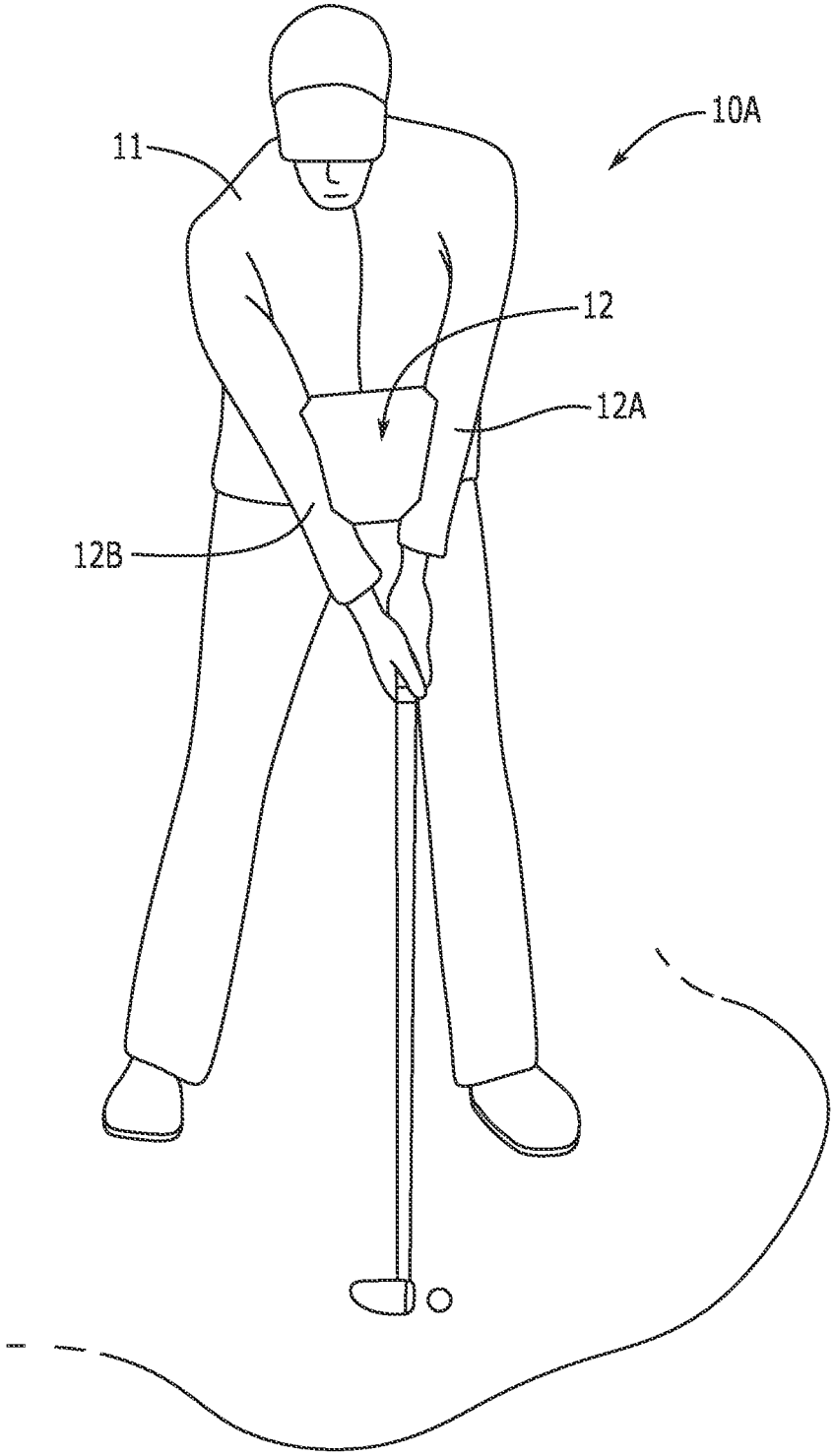
FIG. 1 is a front perspective view of an embodiment of the present invention, in use, showing a right-handed swing orientation.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

Broadly, one embodiment of the present invention is a golf training tool formed as an asymmetrically designed foam wedge with slots defined on lateral edges thereof to receive arms of a user. The present invention advantageously helps an average golfer improve simply by using it and hitting golf balls, giving instant feedback to the user. The present invention forces a user to keep their arms and chest in connection (via the training tool) through their entire swing.

As discussed above, other tools, like balls that require pressure to be applied thereto in order to maintain it in place, require unnatural arm positioning in order for proper function. In stark contrast, the present invention fits comfortably between the arms of a user to allow them to form the triangular shape required for a proper golf swing.

The present invention puts the rear arm in a perfect position to attack a golf ball from the inside. It fits between a user's arms naturally and allows their arms and shoulders to be tension free. Further, it forces a user to turn their body correctly which cuts down on injuries.

Referring now to FIGS. 1-7, a golf training tool 12 is generally depicted as having a substantially trapezoidal main body. The golf training tool 12 may be constructed of a resilient material 20 (e.g., high-density foam) designed to contour a player's forearms, biceps, and chest when properly addressing the ball as well as throughout the range of motion of a proper golf swing. The main body of the tool 12 tapers in profile from a top surface 14 to a narrower, shorter in length, bottom surface 16. In addition to the top surface 14 and bottom surface 16, the main body also includes a first side surface, a second side surface, a front surface (the main face shown in FIG. 2), and a rear surface (the main face shown in FIG. 4).

Figure 2:
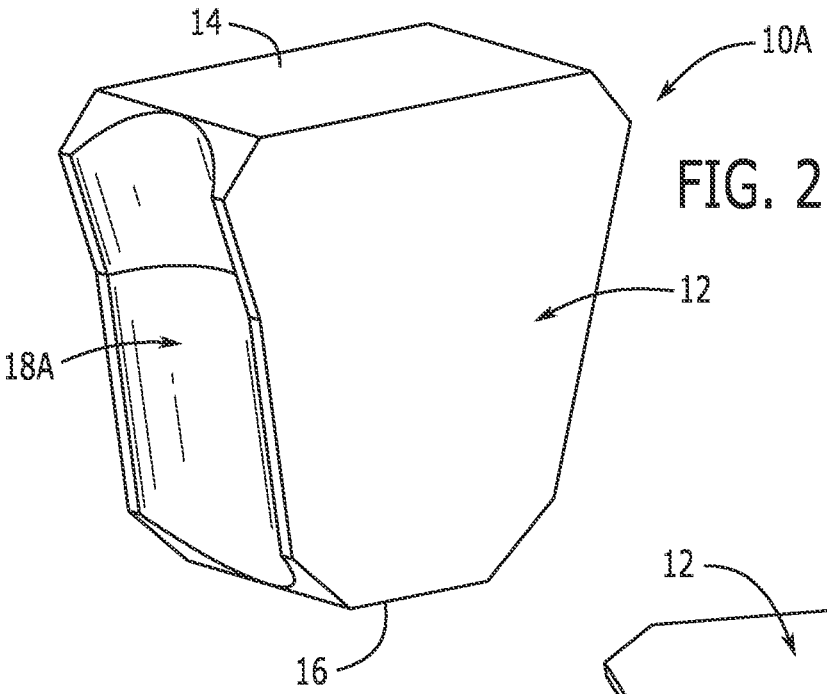
FIG. 2 is a first perspective view of the embodiment of the present invention.
Figure 3:
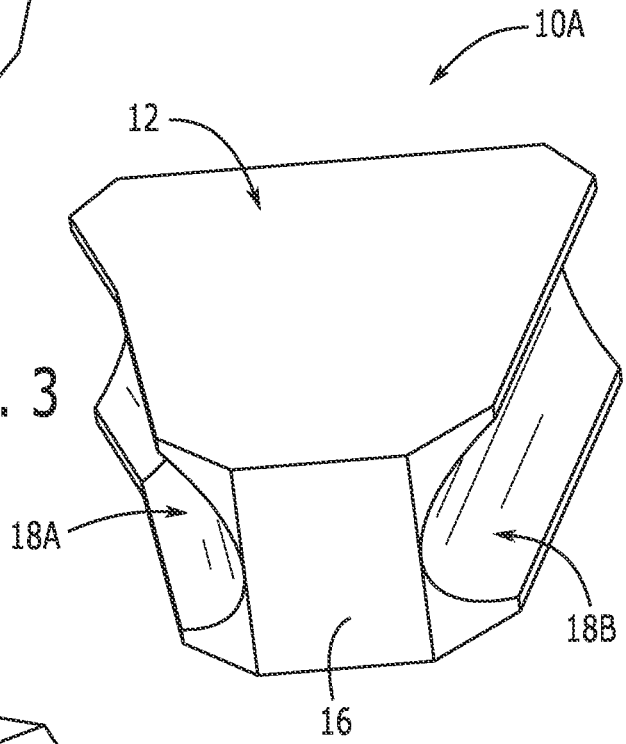
FIG. 3 is another perspective view of the embodiment of the present invention.
Figure 4:
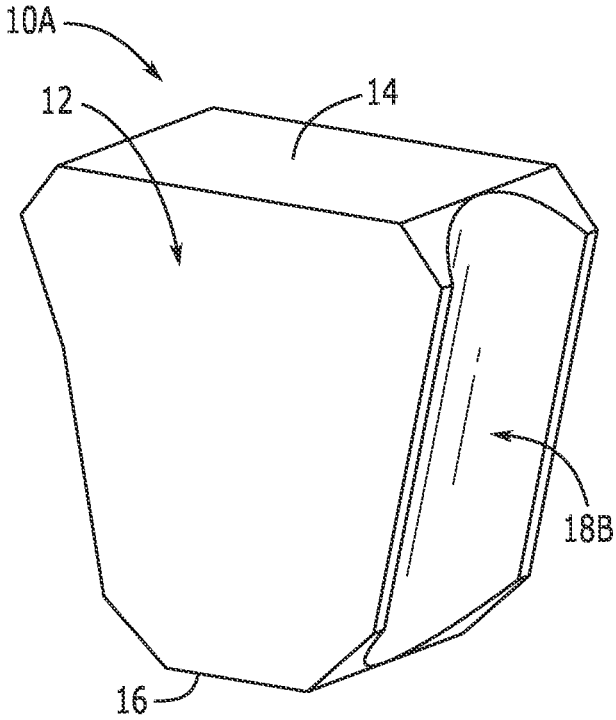
FIG. 4 is a third perspective view of the embodiment of the present invention.
Figure 5:
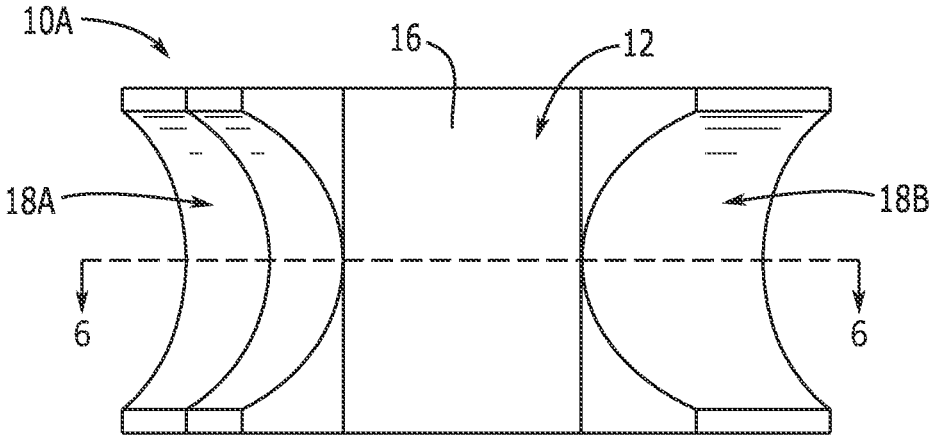
FIG. 5 is a top plan view of the embodiment of the present invention.
Figure 6:
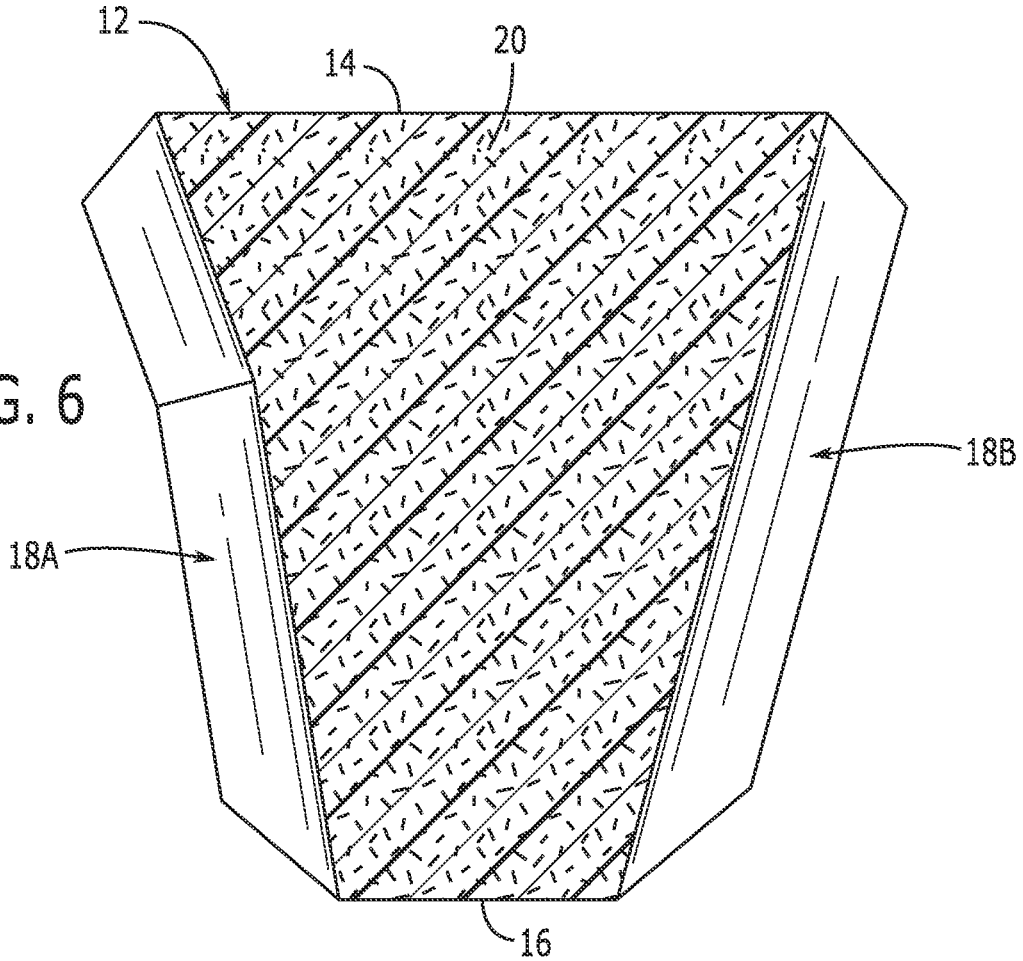
FIG. 6 is a cross-sectional view of the embodiment of the present invention, taken on line 6-6 of FIG. 5

As shown in FIGS. 2-4, two recesses 18A, 18B are defined in the two side surfaces of the tool 12. Specifically, a front arm recess 18A is defined, and a rear arm recess 18B is defined. As used herein, the terms "front" and "rear" are intended to refer to the relative positioning of a golfer's arm in the context of their swing. These terms are also synonymous with the terms "lead" arm and "trailing arm, respectively. The recesses 18A, 18B are formed asymmetrically to allow proper positioning of both arms at address. As seen in FIGS. 3 and 4, the front arm recess 18B is a continuous semi-cylindrical shape from the bottom surface 16 to the top surface 14. The rear arm recess 18A is similarly formed, but includes a small bend 18C towards an upper portion of the rear arm recess 18A.

By way of example, the recesses 18A, 18B may be configured in the following way. The front arm recess 18B may be angled at approximately 75 degrees relative to the top surface 14. The rear arm recess 18A may begin by being angled at approximately 70 degrees relative to the top surface 14. At the bend 18C, the angle of the recess 18A may adjust to approximately 81 degrees relative to the top surface 14 until it terminates at the bottom surface 16. Of course, minor modifications (e.g. +/−5 degrees) may be made to the design, in accordance with the present invention.

Figure 7:
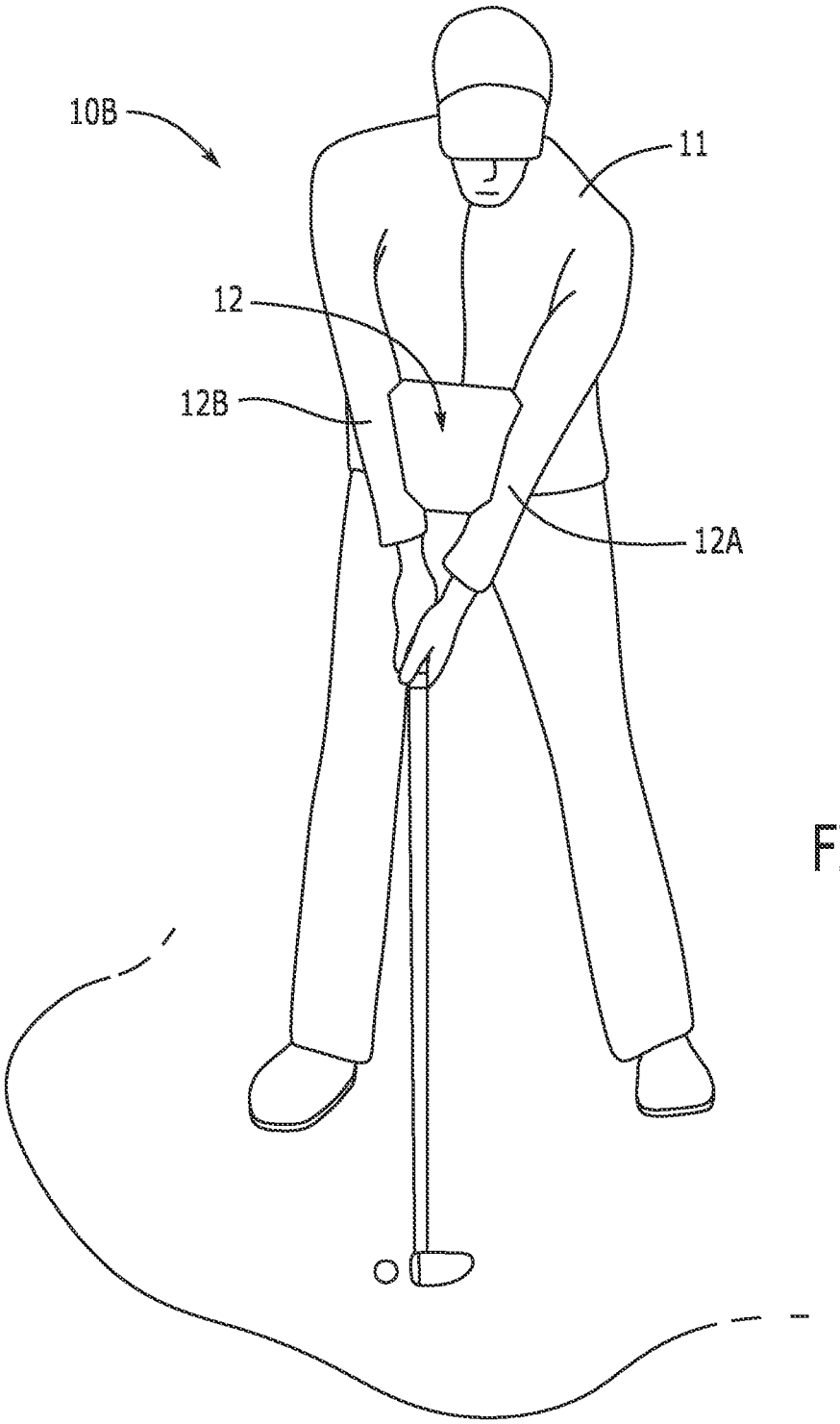
FIG. 7 is a perspective view, similar to FIG. 1, of the embodiment of the present invention, in use, showing a left-handed swing orientation.

Due to the unique design, the tool 12 can simply be flipped over and it is able to accommodate both left-handed and right-handed golfers. As shown in FIGS. 1 and 7, the tool 12 has no external support or fixation to the golfer 11 which requires the golfer 11 to maintain proper form to keep the training tool in position during the golf swing.

As shown in FIGS. 1 and 7, the swing training tool 12 can be positioned based upon the handedness of the golfer 11. For example, a right-handed swing orientation 10A is shown in FIG. 1, with the golfer's left arm 12A being received in the front arm recess 18B and their right arm 12B being received in the rear arm recess. As shown in FIG. 7, if a left handed golfer 11 needs to use the tool 12 in left-handed swing orientation 10 ft the tool 12 can be simply flipped relative to what is shown in FIG. 1. In this scenario, the golfer's left arm 12A is received in the rear arm recess 18A and their right arm 12B is received in the front arm recess 18B.

In use, the tool 12 is simply placed between a golfer's arms 12A, 12B and they can start swinging. The tool 12 forces golfers 11 to pivot (which is a major issue for amateur golfers) because it does not allow the golfer to independently swing their arms. Consequently, they have to turn their chest, which creates the correct pivot. One benefit that golfers are likely to experience is a reduction in lower back pain. This is because, when the triangle created by the golfer's arms and chest when using the tool 12, correct pivoting in the backswing is permitted along with a proper follow through. This, in turn, will create better shots and lower scores for a golfer, resulting in a more enjoyable experience for the golfer.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. The term "substantially" shall be interpreted to mean completely and/or nearly completely. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A golf training tool for a golfer comprising:

a substantially trapezoidal main body configured to be retained between a front arm and a rear arm of the golfer, the main body comprising:

a top surface;

a bottom surface shorter in length than the top surface;

a front side surface defining a front arm recess configured to receive the front arm of the golfer; and a rear side surface defining a rear arm recess configured to receive the rear arm of the golfer, wherein, in use, the main body is configured to be retained in place by only the front arm and the rear arm of the golfer and without one or more external supports, wherein the front arm recess is formed in a continuous semi-cylindrical shape that extends from the bottom surface to the top surface, and wherein the rear arm recess is formed in a semi-cylindrical shape including a bend along a length of the rear arm recess.

2. The golf training tool of claim 1, wherein the bend is disposed towards an upper portion of the rear arm recess.

3. The golf training tool of claim 1, wherein the front side surface and the rear side surface are asymmetrical with one another.

4. The golf training tool of claim 1, wherein the main body is formed from a resilient material.

5. A golf training tool for a golfer comprising:

a substantially trapezoidal main body configured to be retained between a front arm and a rear arm of the golfer, the main body comprising:

a top surface;

a bottom surface shorter in length than the top surface;

a front side surface defining a front arm recess configured to receive the front arm of the golfer; and a rear side surface defining a rear arm recess configured to receive the rear arm of the golfer, wherein, in use, the main body is configured to be retained in place by only the front arm and the rear arm of the golfer and without one or more external supports, and wherein the front side surface and the rear side surface are asymmetrical with one another.

6. The golf training tool of claim 5, wherein the main body is formed from a resilient material.

7. The golf training tool of claim 5, wherein the front arm recess is formed in a continuous semi-cylindrical shape that extends from the bottom surface to the top surface.

8. The golf training tool of claim 5, wherein the rear arm recess is formed in a semi-cylindrical shape including a bend along a length of the rear arm recess.

* * * * *